US009961464B2

(12) United States Patent
Porter et al.

(10) Patent No.: US 9,961,464 B2
(45) Date of Patent: May 1, 2018

(54) PRESSURE GRADIENT MICROPHONE FOR MEASURING AN ACOUSTIC CHARACTERISTIC OF A LOUDSPEAKER

(71) Applicant: Apple Inc., Cupertino, CA (US)

(72) Inventors: Simon K. Porter, San Jose, CA (US); Sylvain J. Choisel, San Francisco, CA (US); Jesse A. Lippert, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days. days.

(21) Appl. No.: 15/275,077

(22) Filed: Sep. 23, 2016

(65) Prior Publication Data

US 2018/0091910 A1 Mar. 29, 2018

(51) Int. Cl.

| | |
|---|---|
| ***H04R 19/04*** | (2006.01) |
| ***H04R 29/00*** | (2006.01) |
| *H04R 3/04* | (2006.01) |

(52) U.S. Cl.

CPC ..... *H04R 29/001* (2013.01); *H04R 19/04* (2013.01); *H04R 3/04* (2013.01); *H04R 2201/003* (2013.01)

(58) Field of Classification Search

CPC .... H04R 1/38; H04R 19/04; H04R 2201/003; H04R 17/02; H01L 2924/1461; B81B 2201/0257; H81B 2201/0264

See application file for complete search history.

(56) References Cited

U.S. PATENT DOCUMENTS

| | | | |
|---|---|---|---|
| 5,588,065 | A | 12/1996 | Tanaka et al. |
| 7,092,535 | B1 | 8/2006 | Pedersen et al. |
| 8,081,782 | B2 | 12/2011 | Klinghult |
| 8,098,853 | B2 | 1/2012 | Tanaka et al. |
| 8,160,282 | B2 | 4/2012 | Christoph et al. |

(Continued)

FOREIGN PATENT DOCUMENTS

| | | |
|---|---|---|
| EP | 0658064 | 6/1995 |
| EP | 07772374 | 5/1997 |

OTHER PUBLICATIONS

Apple Inc., Notice of Allowance dated Apr. 6, 2017, U.S. Appl. No. 14/989,727.

(Continued)

*Primary Examiner* — Thang Tran

(74) *Attorney, Agent, or Firm* — Womble Bond Dickinson (US) LLP

(57) ABSTRACT

A differential pressure gradient micro-electro-mechanical system (MEMS) microphone for measuring an acoustic characteristic of a loudspeaker. The microphone includes a MEMS microphone housing and a compliant membrane mounted in the MEMS microphone housing, the compliant membrane dividing the MEMS microphone housing into a first chamber and a second chamber. The first chamber includes a primary port open to a first side of the compliant membrane and the second chamber includes a secondary port open to a second side of the compliant membrane, and the primary port and the secondary port are tuned with respect to one another to control a pressure difference between the first side and the second side of the compliant membrane such that at least 10 dB of attenuation is observed in a microphone signal output relative to a microphone having a sealed first or second chamber.

20 Claims, 6 Drawing Sheets

(56) References Cited

U.S. PATENT DOCUMENTS

| | | | | |
|---|---|---|---|---|
| 8,526,656 | B2 | 9/2013 | Tanaka et al. | |
| 8,582,788 | B2 | 11/2013 | Leidl et al. | |
| 2003/0194097 | A1 | 10/2003 | Ding | |
| 2006/0088174 | A1 | 4/2006 | DeLeeuw et al. | |
| 2008/0107287 | A1 | 5/2008 | Beard | |
| 2009/0161894 | A1* | 6/2009 | Kimura | H04R 19/016 381/174 |
| 2011/0036174 | A1* | 2/2011 | Hooper | B81B 7/0061 73/721 |
| 2011/0272769 | A1* | 11/2011 | Song | H04R 19/005 257/416 |
| 2014/0003633 | A1* | 1/2014 | Liu | H04R 1/04 381/174 |
| 2014/0003645 | A1 | 1/2014 | Silver et al. | |
| 2014/0225204 | A1* | 8/2014 | Nakagawa | H04R 19/04 257/416 |
| 2015/0060955 | A1* | 3/2015 | Chen | H04R 19/005 257/254 |
| 2015/0237440 | A1 | 8/2015 | Fromel et al. | |
| 2016/0037263 | A1* | 2/2016 | Pal | H04R 19/04 381/113 |
| 2016/0176704 | A1* | 6/2016 | Cargill | H04R 19/005 257/419 |
| 2017/0077887 | A1 | 3/2017 | You | |

OTHER PUBLICATIONS

Lee, J. S., et al., "On the method for estimating the volume velocity of an acoustic source in a chamber", *J. of Sound and Vibration*, 182(4), (1995), 505-522.

* cited by examiner

PRESSURE GRADIENT MICROPHONE FOR MEASURING AN ACOUSTIC CHARACTERISTIC OF A LOUDSPEAKER

FIELD

Embodiments of the invention relate to sensors for measuring audio characteristics of a loudspeaker; and more specifically, to a microphone for measuring a displacement, velocity or acceleration of a loudspeaker system.

BACKGROUND

The displacement or velocity of a loudspeaker diaphragm can be a useful parameter for evaluating the characteristics of any loudspeaker. Current techniques for measuring loudspeaker diaphragm displacement include using an optical sensor, for example a laser displacement sensor or transducer. Such sensors, however, suffer from various drawbacks including, for example, sensitivity to the surface characteristics of the target material (e.g., color, materials, etc.). In addition, with respect to other solutions such as placing an accelerometer on the loudspeaker diaphragm, the acceleration signal has to be integrated (to produce a velocity signal) and any noise in the measurement will cause an accumulated error.

SUMMARY

In one embodiment, the invention relates to a differential pressure gradient micro-electro-mechanical system (MEMS) microphone for indirectly measuring an acoustic characteristic of a loudspeaker. The acoustic characteristic may be, for example, a displacement, velocity or acceleration of the loudspeaker system. Representative applications may include, for example, loudspeaker protection (e.g., excursion limiting), accounting for, or compensating for, nonlinearities (e.g., excursion control), estimation of volume velocity and/or other motion feedback applications. In one embodiment, the differential pressure gradient MEMS microphone is positioned within a back volume of the loudspeaker and used to indirectly measure a displacement, velocity or acceleration of the diaphragm within the loudspeaker. It should be understood, however, that to accurately estimate the displacement, velocity and/or acceleration of a loudspeaker using a MEMS microphone, the MEMS microphone should be able to handle operating levels greater than 130 decibels (dB) sound pressure level (SPL) before limiting at 10% total harmonic distortion (THD). Conventional MEMS microphones, however, have a maximum operating level of 130 dB or less (defined as the 10% THD point). Therefore, in order to achieve an operating level suitable for use with a loudspeaker as described herein, a sensitivity of the MEMS microphone is reduced so that the microphone does not become overloaded. Representatively, in one embodiment, the MEMS microphone is a differential pressure gradient MEMS microphone, which includes a MEMS microphone enclosure having one or more of a resistive/reactive port or pathway between the front and back sides of the MEMS diaphragm positioned therein. For example, the enclosure may have a first port or primary port to a front side of the MEMS diaphragm and a second port or secondary port to a back side of the MEMS diaphragm. The ports may be tuned with respect to one another (e.g., each port having a different surface area, size, and/or acoustic impedance) to control, modify, or otherwise affect, a pressure difference between the front side and the back side of the diaphragm.

By exposing both the front and back sides of the MEMS diaphragm to the same pressure field (e.g., a uniform pressure field within the back volume of the loudspeaker) at the same air temperature, but with each port or path having a different acoustic impedance, a thermally stable, high SPL tolerant (e.g., greater than 130 dB SPL) microphone which can be used to accurately estimate a displacement, velocity and/or acceleration of the loudspeaker is produced. It is further noted that such control and/or attenuation of the microphone is achieved within a low frequency audio band that is 1 kHz or less.

More specifically, one embodiment is directed to a differential pressure gradient microphone for measuring an acoustic characteristic of a loudspeaker. The microphone may be, for example, a micro-electro-mechanical system (MEMS) that includes a MEMS microphone housing and a compliant membrane mounted in the MEMS microphone housing. The compliant membrane may divide the microphone housing into a first chamber and a second chamber. The first chamber may include a primary port that is open to, or in communication with, a first side (e.g., a front side) of the compliant membrane and the second chamber may include a secondary port that is open to, or in communication with, a second side (e.g., a back side) of the compliant membrane. In one embodiment, the primary port and the secondary port may be formed through portions of the wall of the microphone housing forming the first chamber and the second chamber, respectively. In still further embodiments, one of the primary port or the secondary port may be formed through the compliant membrane. For example, the primary port may be formed through the housing wall to the first chamber and the secondary port may be formed trough the compliant membrane to the second chamber. In some cases, another port may be formed through the housing wall to the second chamber, such that there are two ports which open directly to the second chamber. The primary port and the secondary port may be tuned with respect to one another to control, regulated, modify or otherwise affect a pressure difference between the first side and the second side of the compliant membrane such that at least 10 dB of attenuation is observed in a microphone signal output relative to a microphone having a sealed first or second chamber (e.g., no opening through the wall forming the chamber). For example, the primary port and the secondary port may be tuned to have different surface areas. In addition, the primary port and the secondary port may be tuned to have different acoustic impedances. The primary port and the secondary port may be tuned such that a pressure difference between the first side (e.g., front side) and the second side (e.g., back side) is sufficient to lower an excursion of the compliant membrane relative to a microphone having a sealed first or second chamber. The primary port and the secondary port may be tuned such that a pressure difference between the first side and the second side of the compliant membrane is reduced relative to a microphone having a sealed first or second chamber. The primary port and the secondary port may be tuned such that from about 20 dB to about 70 dB of attenuation is observed within a frequency range of less than 1 kHz in a microphone signal output relative to a microphone having a sealed first or second chamber. The primary port and the secondary port may be tuned such that at least 50 dB of attenuation is observed in a microphone signal output relative to a microphone having a sealed first or second chamber. In one aspect, one of the primary port or the secondary port may include a plurality of discrete holes. The plurality of discrete holes may be tuned to have an overall surface area that is different than the surface area of the other of the primary port or the secondary port.

In another embodiment, the invention is directed to a system for indirectly measuring an audio characteristic of a loudspeaker. The system may include a loudspeaker having a front volume chamber formed around a front side of a diaphragm positioned therein and a back volume chamber formed around a back side of the diaphragm. The system may further include a differential pressure gradient microphone positioned within the back volume chamber of the loudspeaker to indirectly measure an audio characteristic of the loudspeaker. The microphone may have a compliant membrane dividing a microphone housing into a first chamber and a second chamber. The first chamber may include a primary port open to, or in communication with, a first side of the compliant membrane and the second chamber may include a secondary port open to, or in communication with, a second side of the compliant membrane. The primary port and the secondary port may be tuned with respect to one another to modify a sensitivity of the microphone to an acoustic output of the loudspeaker. In one aspect, an acoustic impedance of the primary port and the secondary port are tuned with respect to one another such that the sensitivity of the microphone is controlled so that it is operable to measure the audio characteristic of the loudspeaker at an operating level greater than 130 dB sound pressure (SPL). In another aspect, a size of the primary port and a size of the secondary port are different, and the size of the secondary port is selected to cause a reduced pressure difference between the first side and the second side of the compliant membrane such that an excursion of the compliant membrane is reduced with respect to a single ported microphone. For example, the secondary port may be smaller in size than the primary port (e.g., the primary port opening is larger than the second port opening). In other embodiments, one of the primary port or the secondary port may include an open surface area sufficient to achieve an at least 10 dB to 30 dB attenuation of the microphone signal output at a first frequency and an at least 45 dB to 70 dB attenuation of the microphone signal output at a second frequency, wherein the first frequency is higher than the second frequency and the attenuation is with respect to a single ported microphone. In some cases, one of the primary port or the secondary port has an open surface area sufficient to achieve an at least 10 dB attenuation of the microphone signal output within a frequency range of less than 1 kHz with respect to a single ported microphone. The primary port may include a single opening and the secondary port comprises a plurality of discrete openings, wherein an overall surface area of the plurality of discrete openings is different than the single opening. The primary port and the secondary port may be tuned with respect to one another to control, modify or otherwise affect a sensitivity of the microphone in the absence of an acoustically resistive material. In one aspect, the audio characteristic of the loudspeaker is one of a displacement, velocity or acceleration of the loudspeaker diaphragm. In addition, the back volume chamber of the loudspeaker may form a uniform pressure field around the microphone such that tuning of the primary port and the secondary port with respect to one another causes a difference in magnitude between a sound pressure impinging upon the first side and a sound pressure impinging upon the second side of the compliant membrane.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In the following description, numerous specific details are set forth. However, it is understood that embodiments of the invention may be practiced without these specific details. In other instances, well-known circuits, structures and techniques have not been shown in detail in order not to obscure the understanding of this description.

In the following description, reference is made to the accompanying drawings, which illustrate several embodiments of the present invention. It is understood that other embodiments may be utilized, and mechanical compositional, structural, electrical, and operational changes may be made without departing from the spirit and scope of the present disclosure. The following detailed description is not to be taken in a limiting sense, and the scope of the embodiments of the present invention is defined only by the claims of the issued patent.

The terminology used herein is for the purpose of describing particular embodiments only and is not intended to be limiting of the invention. Spatially relative terms, such as "beneath", "below", "lower", "above", "upper", and the like may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a", "an", and "the" are intended to include the plural forms as well, unless the context indicates otherwise. It will be further understood that the terms "comprises" and/or "comprising" specify the presence of stated features, steps, operations, elements, and/or components, but do not preclude the presence or addition of one or more other features, steps, operations, elements, components, and/or groups thereof.

The terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

Figure 1:
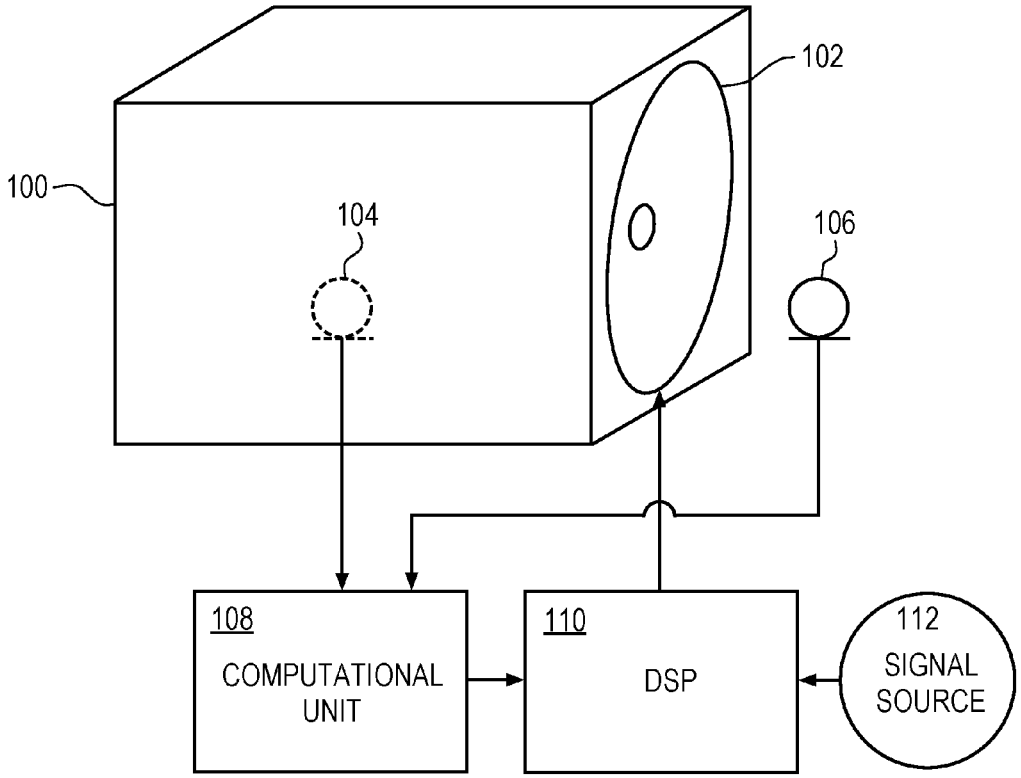
FIG. 1 is a block diagram of one embodiment of a loudspeaker system.

FIG. 1 is a view of an illustrative loudspeaker system containing a driver 102, which may be a low frequency driver such as a woofer or a sub-woofer. The driver may, for example, be an electric-to-acoustic transducer having a diaphragm and circuitry configured to produce a sound in response to an electrical audio signal input (e.g., a loudspeaker). The driver is in a "sealed" enclosure 100 that creates a back volume around a back side of a diaphragm of driver 102. The back volume is the volume inside the enclosure 100. "Sealed" indicates that the back volume does not transfer air to the outside of the enclosure 100 at the frequencies at which the driver operates, or to, for example, a front volume chamber formed around a front side of the diaphragm of the driver. In one embodiment, the enclosure 100 may have a small leak so internal and external pressures can equalize over time, to compensate for changes in barometric pressure or altitude. A porous paper loudspeaker cone, or an imperfectly sealed enclosure may provide this slow pressure equalization. The enclosure 100 may have dimensions that are much less than the wavelengths produced by the driver.

An internal microphone 104 may be placed inside the back volume of the loudspeaker enclosure 100. The internal microphone 104 may, in one embodiment, be a MEMS microphone used to indirectly measure volume velocity, displacement and/or acceleration of the loudspeaker diaphragm as will be described in more detail in reference to, for example, FIG. 3. In some embodiments, an optional external microphone for measuring an acoustic pressure for the purposes of, for example, low-frequency equalization may also be provided. Any one or more of the microphones disclosed herein may be considered an acoustic-to-electric transducer and include a diaphragm and circuitry configured to produce an audio signal in response to a sound input.

The loudspeaker system further includes a computational unit 108 and a digital signal processor (DSP) 110. The computational unit may be a microprocessor or microcontroller and it may be optimized for the computation of transfer functions. The DSP may be optimized for the processing of digital or analog audio signals and configurable according to the computed transfer functions. Thus, the loudspeaker system may include components for processing of analog and/or digital audio signals. The computational unit 108 and the DSP 110 may be implemented with the same hardware in some embodiments. In some embodiments, the computational unit 108 and/or the DSP 110 are located in or on the enclosure 100. In some other embodiments, the computational unit 108 and the DSP 110 are provided as a signal processor that is separate from the loudspeaker system.

The DSP 110 provides an adaptive equalization filter that receives an audio signal from an external signal source 112, such as an amplifier coupled to the loudspeaker system, and provides a filtered audio signal to the driver 102 of the loudspeaker system. The computational unit 108 may be coupled to the internal microphone 104 and be used to estimate a volume velocity, acceleration of displacement of the loudspeaker diaphragm using the instantaneous pressure in the back volume as measured by the internal microphone 104.

Assuming a sealed box, at low frequencies having wavelengths significantly larger than the dimension of the box, the sound field inside the enclosure 100 is a pressure field. The instantaneous pressure is uniform and varies in phase with the displacement of the loudspeaker. In some embodiments, the loudspeaker displacement may be estimated for frequencies at which the pressure-field assumption is not strictly valid, by using a compensation filter to account for the propagation between the loudspeaker diaphragm and the internal microphone. This is suitable at frequencies below the first resonance of the enclosure, or if the internal microphone is placed away from any pressure notch in the enclosure.

If an adiabatic process, i.e., one in which no heat is transferred into or out of the woofer enclosure 100 while the pressure inside of the enclosure fluctuates, is assumed, the adiabatic gas law may be used to estimate the loudspeaker displacement using an estimate of the pressure inside the enclosure 100 based on the internal microphone signal. The adiabatic gas law for an ideal gas states that pressure p and volume V are exponentially related:

$$pV^{\gamma}=k \text{ (constant)}$$

where $\gamma=7/5$ for a diatomic gas (valid for air).

The loudspeaker diaphragm of driver 102 can be modeled as a piston (with a surface area 5) moving back and forth with instantaneous displacement x(t) around its rest position.

Figure 2:
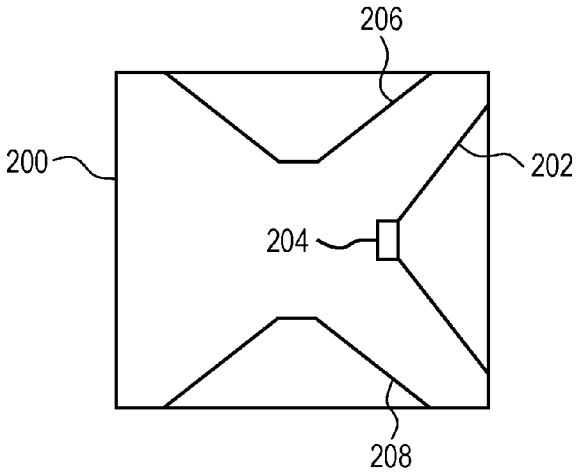
FIG. 2 is a schematic cross-section of one embodiment of a loudspeaker that includes passive drivers.

FIG. 2 is a schematic cross-section of a loudspeaker 200 that includes passive radiators 206, 208 in addition to a driven diaphragm 202. A motor 204, such as a voice coil motor, drives the diaphragm 202 in response to an electrical signal. The passive radiators 206, 208 are moved by the acoustic pressure waves created by the driven diaphragm 202. In a loudspeaker 200 that includes passive radiators 206, 208 the surface area S is the total surface area of the driven and passive diaphragms. The loudspeaker 200 that includes passive radiators 206, 208 may include internal (optional external microphones), a computational unit, and a DSP similar to those illustrated in FIG. 1.

Figure 3:
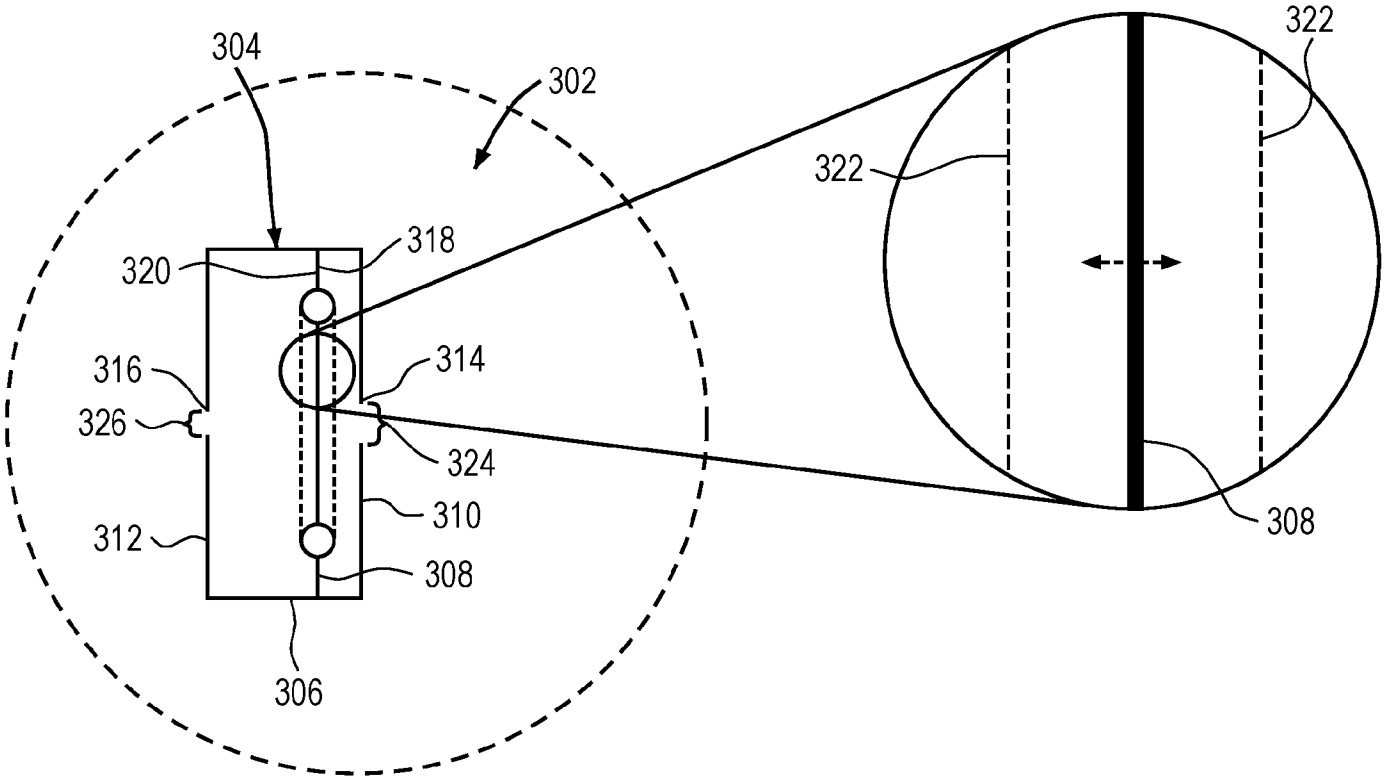
FIG. 3 is a schematic cross-section of one embodiment of a differential pressure gradient microphone within the loudspeaker system of FIG. 1.

FIG. 3 is a schematic cross-section of one embodiment of an internal microphone such as that described in reference to FIG. 1 and FIG. 2. In one embodiment, the internal microphone is a differential pressure gradient microphone 304 having a reduced sensitivity so that it is operable to measure an acoustic characteristic of a loudspeaker. Microphone 304 may be, for example, a micro-electro-mechanical system (MEMS) microphone. It is contemplated, however, that microphone 304 could be any type of transducer operable to convert sound into an audio signal, for example, a piezoelectric microphone, a dynamic microphone or an electret microphone. As previously discussed, microphone 304 is positioned within a back volume chamber 302 formed by a loudspeaker enclosure sealed to the back side of the loudspeaker diaphragm (e.g., the back volume chamber formed by enclosure 100 behind the diaphragm of driver 102 described in reference to FIG. 1). In other words, microphone 304 is positioned within, and designed to operate within, a chamber having a uniform pressure field in which any change in pressure is the same throughout the chamber, as opposed to an ambient or other environment in which pressure change is variable. Microphone 304 may include a microphone housing or enclosure 306 (e.g., a MEMS microphone enclosure) that encloses a compliant membrane 308 (e.g., a microphone diaphragm) as well as any other microphone components necessary for operation of microphone 304 (e.g., actuator, circuitry, etc.). The compliant membrane 308 may be positioned within the microphone enclosure 306 such that it divides microphone enclosure 306 into a first chamber 310 and a second chamber 312. First chamber 310 may be acoustically coupled to a front side 318 (e.g., a first side) of compliant membrane 308 while second chamber 312 may be acoustically coupled to a back side 320 (e.g., a second side) of compliant membrane 308. In other words, first chamber 310 defines an acoustic volume or cavity around the front side 318 and second chamber 312 defines an acoustic volume or cavity around the back side 320 of compliant membrane 308.

The first chamber 310 may include a primary acoustic port 314 formed through the wall of enclosure 306 and which forms an acoustic pathway between the back volume chamber 302 of the loudspeaker and the front side 318 of the compliant membrane 308. The second chamber 312 may further include a secondary acoustic port 316 formed through the wall of enclosure 306 and which forms an acoustic pathway between the back volume chamber 302 of the loudspeaker and the back side 320 of the compliant membrane 308. The primary acoustic port 314 and the secondary acoustic port 316 are tuned with respect to one another in order to create a pressure gradient across compliant membrane 308, and control a sensitivity of microphone 304.

It should be understood that by providing tuned acoustic pathways to both the first chamber 310 and the second chamber 312 from the loudspeaker volume chamber 302, the difference in pressure between the front side 318 and the back side 320 of the compliant membrane 308 can be controlled. This in turn provides a mechanism for controlling a sensitivity of the microphone 304 so that it can be used to accurately estimate or otherwise measure, for example, the displacement, velocity and/or acceleration of a loudspeaker diaphragm. For example, in a conventional omnidirectional microphone, the enclosure may include a single port (e.g., a sound input port), which is acoustically coupled to a front side of a diaphragm (e.g., a sound pick up face of the diaphragm). The back side of the diaphragm, however, is sealed within the enclosure (e.g., a back volume chamber). As a result, the back side of the diaphragm is exposed to a fixed "reference" air pressure which may be much higher than a pressure on the front side of the diaphragm, thus creating a relatively large pressure difference between the two, and in turn, a highly sensitive microphone. For example, the microphone may have a maximum operating level of less than 130 dB SPL (defined as the 10% THD point) and overload at levels greater than 130 dB SPL. Due to the sensitivity of such a microphone, it cannot accurately measure, for example, the displacement, velocity and/or acceleration of a loudspeaker diaphragm.

The microphone 304 of FIG. 3, however, solves this problem by including a secondary port 316 to the second chamber 312 surrounding the back side 320 of compliant membrane 308 which is acoustically tuned with respect to the primary port 314 so that a pressure difference between a front side 318 and a back side 320 of the compliant membrane 308 is controlled or modified to within a range suitable for operation of microphone 304 at levels greater than 130 dB SPL. For example, the ports can be tuned so that a pressure difference between the front side 318 and the back side 320 of compliant membrane 308 is reduced, thus reducing a sensitivity of microphone. It should be understood that when characteristics of microphone 304 are referred to herein as being "reduced", "reduces" or "reducing", the reduction in pressure difference is in comparison to a microphone having a sealed back volume chamber (e.g., an omnidirectional microphone without openings to both front and back volumes) and operating under similar conditions (e.g., within a sealed back volume chamber of a loudspeaker).

In one embodiment, the degree to which the sensitivity of microphone 304 is reduced, or otherwise changed, is dictated by the sizes or open surface area of the primary port 314 and the secondary port 316 with respect to one another. In other words, a ratio between an open surface area or size of the primary port 314 and that of the secondary port 316 is such that a desired pressure difference between the front side 318 and the back side 320 of the compliant membrane 308 is achieved, and in turn, a desired level of sensitivity. The pressure difference in some embodiments is lower than the pressure difference achieved by a single ported microphone having a sealed back volume chamber so that the microphone is not too sensitive to operate at an increased SPL (e.g., greater than 130 SPL) before limiting at 10% THD.

To achieve this, in one embodiment, the size, open surface area, acoustic impedance and/or acoustic resistance of the secondary port 316 is different than that of the primary port 314. For example, in one embodiment, an acoustic impedance or acoustic resistance of the secondary port 316 is greater than that of the primary port 314. Said another way, as shown in FIG. 3, a size or open surface area 326 of the secondary port 316 is less than a size or open surface area 324 of the primary port 314 (e.g., the primary port 314 is larger than the secondary port 316). In this aspect, for a given external pressure (e.g., pressure within the back volume chamber of the loudspeaker), the secondary port 316 creates a resistive pathway or vent to the back side 320 of compliant membrane 308 (more resistive than the primary port 314) which in turn reduces a pressure difference across compliant membrane 308 (e.g., as compared to a single ported microphone within the same environment). This, in turn, lowers the compliant membrane excursion allowing for exposure to increased SPL before limiting at 10% THD (e.g., as compared to a single ported microphone within the same environment). For example, as can be seen from the exploded view of compliant membrane 308 in FIG. 3, the compliant membrane 308 may have an excursion range as represented by dashed lines 322, while an excursion range of a compliant membrane in a single ported microphone, or other microphone having a higher pressure differential, may be much larger.

It should further be understood that in other embodiments, an acoustic resistance or acoustic impedance of primary port 314 and secondary port 316 with respect to one another may be tuned by controlling a length of the pathway to the respective sides of the compliant membrane. For example, secondary port 316 may be associated with a channel feeding into the back side 320 of compliant membrane 308. In this aspect, the dimensions of the channel may be changed to control a resistance of the channel to an acoustic flow through the channel. For example, the channel could be made longer, or could be made narrower, to increase an acoustic resistance of acoustic impedance so that it is greater than that of primary port 314.

It should be understood, however, that in each embodiment, the magnitude of the acoustic pressure acting upon each side of the compliant membrane 308 is controlled, or otherwise modified, by tuning or calibrating characteristics of the primary and secondary ports 314, 316 with respect to one another to achieve the desired results, as opposed to, for example, adding an acoustic material or changing an external pressure at the port itself. In other words, the microphone is in a uniform pressure field (e.g., the back volume of the loudspeaker) and the ports themselves are specifically designed to, for example, control or modify a magnitude of pressure impinging upon the back side 320 so that the pressure on the front side 318 of compliant membrane 308 is within a desired range during all anticipated pressure levels. In addition, it should be understood that in one embodiment, the acoustic characteristics of the primary and secondary ports 314, 316 are controlled in the absence of additional acoustic materials, for example, an acoustically resistive material such as a mesh, membrane or the like positioned over one or more of the ports. In this aspect, microphone 304 is considered thermally stable, or more thermally stable in comparison to a microphone requiring an acoustically resistive material to modify the acoustic properties of one or more of the ports. In particular, it has been found that in some cases, the resistivity of an acoustic material may vary with temperature, and in turn, the performance of the device will also vary. Since microphone 304 does not require the use of an acoustically resistive material to control the sensitivity as previously discussed, the acoustic performance is consistent regardless of a temperature of the surrounding environment.

Figure 4:
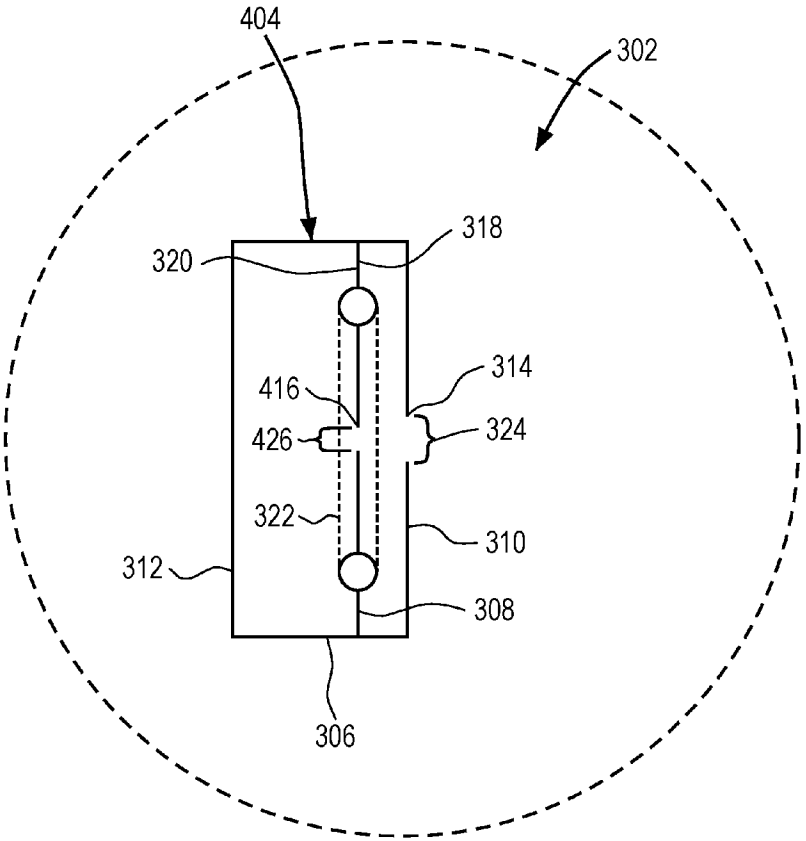
FIG. 4 is a schematic cross-section of another embodiment of a differential pressure gradient microphone within the loudspeaker system of FIG. 1.

FIG. 4 is a schematic cross-section of another embodiment of an internal microphone such as that described in reference to FIG. 1 and FIG. 2. In one embodiment, the internal microphone is a differential pressure gradient microphone 404 having a reduced sensitivity so that it is operable to measure an acoustic characteristic of a loudspeaker. Microphone 404 may be, for example, a micro-electro-mechanical system (MEMS) microphone. It is contemplated, however, that microphone 404 could be any type of transducer operable to convert sound into an audio signal, for example, a piezoelectric microphone, a dynamic microphone or an electret microphone. Microphone 404 may be substantially similar to microphone 304 discussed in reference to FIG. 3. In this aspect, microphone 404 may include similar components to microphone 304 and be positioned within a back volume chamber 302 formed by a loudspeaker enclosure sealed to the back side of the loudspeaker diaphragm (e.g., the back volume chamber formed by enclosure 100 behind the diaphragm of driver 102 described in reference to FIG. 1). In other words, similar to microphone 304, microphone 404 is positioned within, and designed to operate within, a chamber having a uniform pressure field in which any change in pressure is the same throughout the chamber, as opposed to an ambient or other environment in which pressure change is variable. In this aspect, microphone 404 may include a microphone enclosure 306 that encloses a compliant membrane 308 (e.g., a microphone diaphragm) as well as any other microphone components necessary for operation of microphone 304 (e.g., actuator, circuitry, etc.), as previously discussed in reference to FIG. 3. The compliant membrane 308 may be positioned within the microphone enclosure 306 and divide microphone enclosure 306 into a first chamber 310 and a second chamber 312. First chamber 310 may be acoustically coupled to a front side 318 (e.g., a first side) of compliant membrane 308 while second chamber 312 may be acoustically coupled to a back side 320 (e.g., a second side) of compliant membrane 308. In other words, first chamber 310 defines an acoustic volume or cavity around the front side 318 and second chamber 312 defines an acoustic volume or cavity around the back side 320 of compliant membrane 308.

The first chamber 310 may include a primary acoustic port 314 formed through enclosure 306 to the front side 318 of compliant membrane 308, as previously discussed in reference to FIG. 3. In this embodiment, however, a secondary acoustic port 416 is formed through compliant membrane 308. In this aspect, secondary acoustic port 416 is considered open to second chamber 312 (e.g., to the back side 320 of compliant membrane 320), but in this case, is between first chamber 310 and second chamber 312. Secondary acoustic port 416 may be provided instead of, or in addition to, the secondary acoustic port 316 formed through enclosure 306, as previously discussed in reference to FIG. 3. In this aspect, an acoustic pathway from the back volume chamber 302 of the loudspeaker to the second chamber 312 (e.g., to the back side 320 of compliant membrane 320) is through the first chamber 310. The wall of enclosure 306 forming the second chamber 312 around the back side 320 of compliant membrane 308 may be void of any further ports as shown, or may include an additional port (e.g., secondary opening 316) for further sensitivity tuning.

The primary acoustic port 314 and the secondary acoustic port 416 may be tuned with respect to one another in order to create a pressure gradient across compliant membrane 308, and control a sensitivity of the microphone 404, as previously discussed in reference to FIG. 3. In particular, by providing tuned acoustic pathways to both the first chamber 310 and the second chamber 312 from the loudspeaker volume chamber 302, the difference in pressure between the front side 318 and the back side 320 of the compliant membrane 308 can be controlled. This in turn provides a mechanism for controlling, modifying or otherwise affecting a sensitivity of the microphone 404 so that it can be used to accurately estimate or otherwise measure, for example, the displacement, velocity and/or acceleration of a loudspeaker diaphragm. For example, primary acoustic port 314 and secondary acoustic port 416 can be tuned so that a pressure difference between the front side 318 and the back side 320 of compliant membrane 308 is reduced, thus reducing a sensitivity of microphone 404.

In one embodiment, the degree to which the sensitivity of microphone 404 is reduced, or otherwise changed, is dictated by the sizes or open surface area of the primary port 314 and the secondary port 416 with respect to one another. In other words, a ratio between an open surface area or size of the primary port 314 and that of the secondary port 416 is such that a desired pressure difference between the front side 318 and the back side 320 of the compliant membrane 308 is achieved, and in turn, a desired level of sensitivity. For example, in one embodiment, an acoustic impedance or acoustic resistance of the secondary port 416 is greater than that of the primary port 314. Said another way, as shown in FIG. 4, a size or open surface area 426 of the secondary port 416 is less than a size or open surface area 324 of the primary port 314 (e.g., the primary port 314 is larger than the secondary port 316). In this aspect, for a given external pressure (e.g., pressure within the back volume chamber of the loudspeaker), the secondary port 416 creates a resistive pathway or vent to the back side 320 of compliant membrane 308 (more resistive than the primary port 314) which in turn reduces a pressure difference across compliant membrane 308 (e.g., as compared to a single ported microphone within the same environment). This, in turn, lowers the compliant membrane excursion allowing for exposure to increased SPL before limiting at 10% THD (e.g., as compared to a single ported microphone within the same environment). In other embodiments, an acoustic resistance or acoustic impedance of primary port 314 and secondary port 416 with respect to one another may be tuned by controlling a length of the pathway to the respective sides of the compliant membrane.

It should be understood, however, that in each embodiment, the magnitude of the acoustic pressure acting upon each side of the compliant membrane 308 is controlled, or otherwise modified, by tuning or calibrating characteristics of the primary and secondary ports 314, 416 with respect to one another to achieve the desired results, as opposed to, for example, adding an acoustic material or changing an external pressure at the port itself. In other words, the microphone is in a uniform pressure field (e.g., the back volume of the loudspeaker) and the ports themselves are specifically designed to, for example, control or modify a magnitude of pressure impinging upon the back side 320 so that the pressure on the front side 318 of compliant membrane 308 is within a desired range during all anticipated pressure levels. In turn, compliant membrane 308 may have a desired excursion range as represented by dashed lines 322, while an excursion range of a compliant membrane in a single ported microphone, or other microphone having a higher pressure differential, may be much larger.

In addition, it should be understood that in one embodiment, the acoustic characteristics of the primary and secondary ports 314, 416 are controlled in the absence of additional acoustic materials, for example, an acoustically resistive material such as a mesh, membrane or the like positioned over one or more of the ports. In this aspect, microphone 404 is considered thermally stable, or more thermally stable in comparison to a microphone requiring an acoustically resistive material to modify the acoustic properties of one or more of the ports. In particular, it has been found that in some cases, the resistivity of an acoustic material may vary with temperature, and in turn, the performance of the device will also vary. Since microphone 404 does not require the use of an acoustically resistive material to control the sensitivity as previously discussed, the acoustic performance is consistent regardless of a temperature of the surrounding environment.

Figure 5:
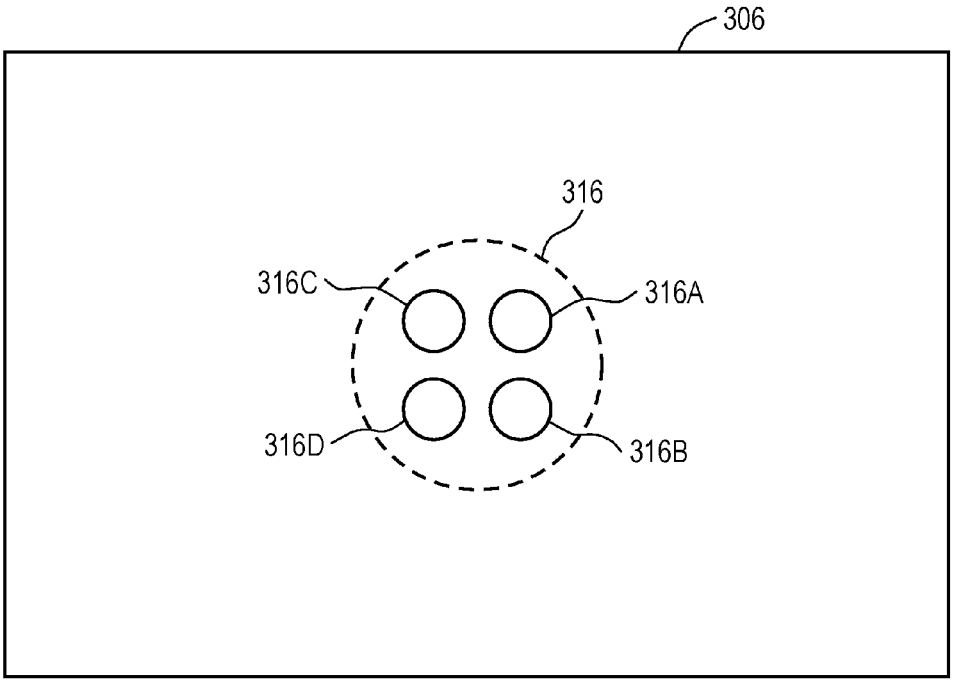
FIG. 5 is a top plan view of one embodiment of a port of the microphone of FIG. 3 and/or FIG. 4.

In addition, although in one embodiment secondary port 316 and/or secondary port 416 may be formed by a single opening as shown in FIG. 3 and FIG. 4, in other embodiments, secondary port 316 may be formed by a plurality of discrete openings as shown in FIG. 5. For example, in one embodiment, secondary port 316 (or secondary port 416) within enclosure 306 may be formed by a number of discrete ports 316A, 316B, 316C and 316D. Although four discrete ports 316A-316D are illustrated, it is contemplated that any number of discrete ports may be used, for example, 8, 32 or 64. A size of each of discrete ports 316A-316D may be selected such that an overall surface area, size, acoustic resistance or acoustic impedance of each of discrete ports 316A-316D together is tuned with respect to primary port 314 (e.g., greater acoustic resistance). It is noted that the use of multiple discrete ports may provide advantages from a manufacturing and microphone performance standpoint. For example, the plurality of discrete ports may allow for more fine tuning of the microphone sensitivity. In particular, for a single port with ±10% tolerance, a small change in the size of one hole with respect to the other makes a large difference in attenuation. Thus, by using discrete ports with a given manufacturability tolerance (e.g., ±10%) the standard deviation around the mean by a factor of $\sqrt{2}$ could be reduced every time the amount of ports is doubled.

It should be understood that although various characteristics of the secondary port 316 and secondary port 416 are specifically referred to herein, the primary port 314 may instead include any one or more of the acoustic characteristics referenced herein with respect to secondary port 316 or secondary port 416. In other words, the ports may be interchangeably referred to herein, with the most important characteristic being that they have different acoustic characteristics.

Figure 6:
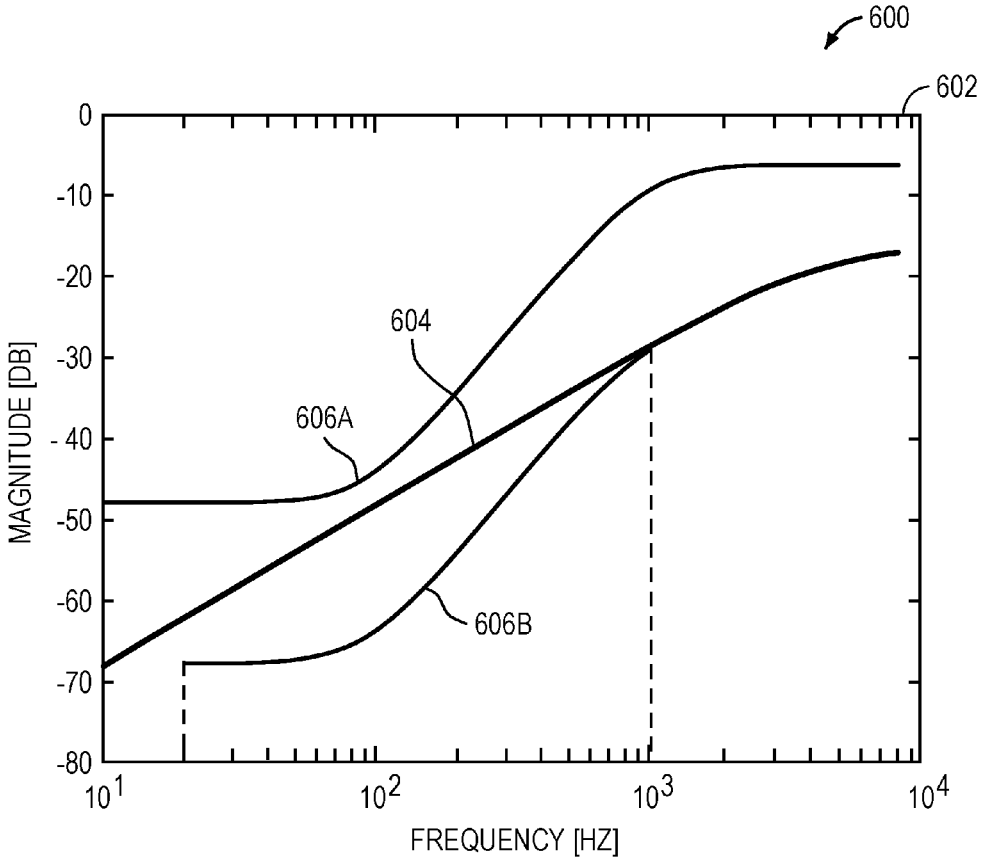
FIG. 6 is a frequency response curve showing an attenuation range of the differential pressure gradient microphone of FIG. 3 and/or FIG. 4.

FIG. 6 is a frequency response curve showing an example attenuation range of the differential pressure gradient microphone of FIG. 3 and FIG. 4. In particular, graph 600 illustrates an attenuation range for maximum signal-to-noise ratio (SNR) in the particular application disclosed herein. In particular, from graph 600 it can be seen that a controlled amount of attenuation is achieved by tuning the primary and secondary ports of microphone 304 and 404 as previously discussed. The degree of attenuation is illustrated with respect to the response of a reference microphone (e.g., single ported microphone) which is represented by a flat line 602 (at magnitude 0 dB), while a pressure gradient microphone having tuned acoustic ports as described herein is illustrated by the curve 604 and an example desired or target attenuation range is represented by the area between curves 606A, 606B, between which lies curve 604. The upwardly inclined nature of curve 604 shows that microphones 304 and 404 are less sensitive at relatively low frequency ranges. For example, the magnitude or degree of attenuation may be at least 10 dB, or 20 dB with respect to a reference microphone and may increase at lower frequencies. For example, in one embodiment, the pressure gradient microphone may be attenuated within a range of about 45 dB to about 70 dB (for example 50 dB) at frequencies below 100 Hz, but within a range of about 5 dB to about 30 dB above 1 kHz, and gradually change therebetween. The magnitude of attenuation is therefore considered to increase as the frequency decreases (e.g., attenuation is higher within a low frequency range). For example, the degree of attenuation is greater at less than 0.1 kHz than between 0.1 kHz and 1 kHz. For example, in one embodiment, the ports are tuned to achieve between 10 dB to 30 dB attenuation of the microphone signal output at a high frequency (e.g., 1 kHz and above) and 45 dB to 70 dB attenuation of the microphone signal output at a low frequency (e.g., 0.1 kHz or less).

Figure 7:
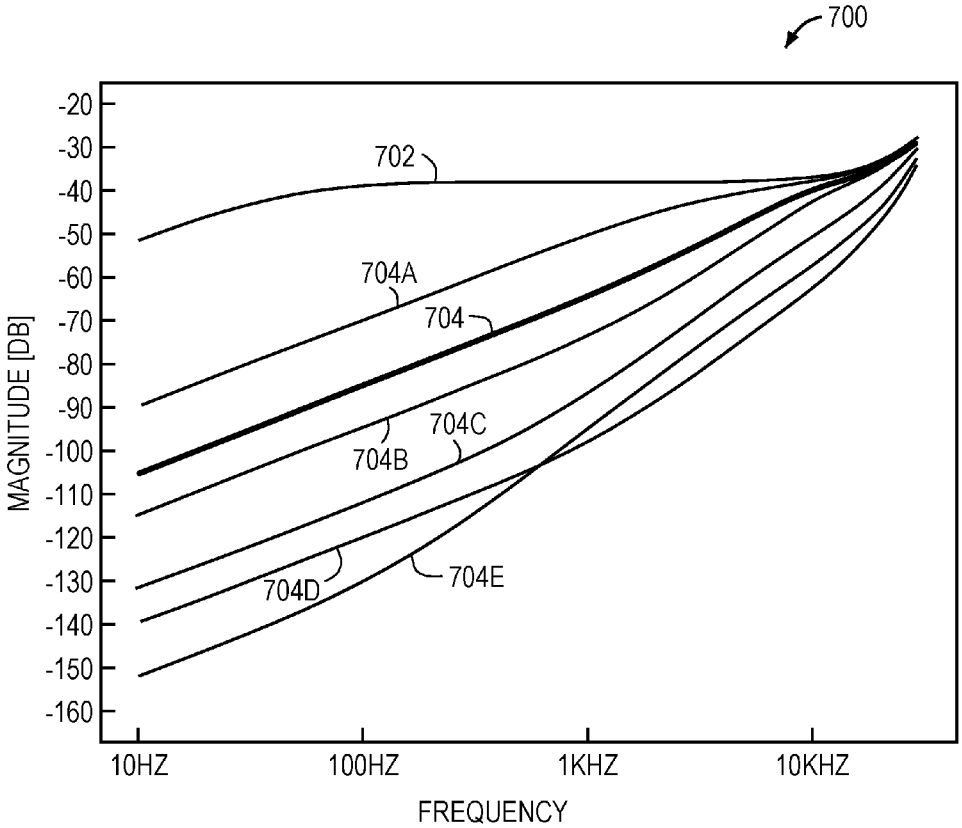
FIG. 7 is a frequency response curve showing an attenuation range at various port sizes within the differential pressure gradient microphone of FIG. 3 and/or FIG. 4.

In addition to being able to control the level of attenuation by tuning one port with respect to another, attenuation can be controlled by varying the size of the secondary port alone as shown in graph 700 of FIG. 7. In particular, FIG. 7 is a graph of various frequency response curves showing different attenuation behavior achieved for various port sizes, within the differential pressure gradient MEMS microphone of FIG. 3 and/or FIG. 4. In particular, the graph 700 shows that a curve 702 of a reference microphone (e.g., a single ported microphone), can be modified into curve 704, and curves 704A-704E by changing a size of the secondary port. As the size of the second port increases (e.g., curve 704A represents the smallest port size while line 704E represents the largest port size) the degree of attenuation increases. In addition, it can be seen that the greatest degree of attenuation occurs within the lower frequency ranges (e.g., a frequency range less than 1 kHz). It should further be understood that in addition to controlling the size of the secondary port, the attenuation may be further tuned, or otherwise controlled, by changing the volume of the enclosure of the MEMS microphone chamber or changing the acoustic characteristics of the primary port (e.g., making the port more or less acoustically resistive by adding a membrane for example that covers the opening of the port).

An exemplary equation used to measure, or otherwise estimate, the acoustic characteristics of the loudspeaker (e.g., diaphragm displacement, velocity or acceleration) using the microphone disclosed herein will now be described in more detail.

Representatively, in one embodiment the instantaneous loudspeaker displacement x(t) may be estimated using an estimate of the pressure inside the enclosure 100 described in reference to FIG. 1 based on the internal microphone signal and the following relationships:

$$x(t)=(-p_{int}(t)V_0)/(\rho_0 c^2 S)$$

where $V_0$ is the volume of the woofer enclosure when the woofer is at rest, $\rho_0$ is the density of air, c is the speed of sound and S is the diaphragm surface area.

While certain exemplary embodiments have been described and shown in the accompanying drawings, it is to be understood that such embodiments are merely illustrative of and not restrictive on the broad invention, and that this invention is not limited to the specific constructions and arrangements shown and described, since various other modifications may occur to those of ordinary skill in the art. The description is thus to be regarded as illustrative instead of limiting.

What is claimed is:

1. A differential pressure gradient micro-electro-mechanical system (MEMS) microphone for measuring an acoustic characteristic of a loudspeaker, the microphone comprising:

a MEMS microphone housing; and a compliant membrane mounted in the MEMS microphone housing, the compliant membrane dividing the MEMS microphone housing into a first chamber and a second chamber, and wherein the first chamber comprises a primary port open to a first side of the compliant membrane and the second chamber comprises a secondary port open to a second side of the compliant membrane, and wherein the primary port and the secondary port are tuned with respect to one another to have different surface areas and control a pressure difference between the first side and the second side of the compliant membrane such that at least 10 dB attenuation is observed in a microphone signal outputted by the MEMS microphone.

2. The microphone of claim 1 wherein a surface area of the primary port is greater than a surface area of the secondary port.

3. The microphone of claim 1 wherein one of the different surface areas achieves at least 10 dB attenuation in the microphone signal outputted by the MEMS microphone.

4. The microphone of claim 1 wherein the primary port and the secondary port are tuned such that a pressure difference between the first side and the second side of the compliant membrane is sufficient to lower an excursion of the compliant membrane relative to a microphone having a sealed first or second chamber.

5. The microphone of claim 1 wherein the primary port and the secondary port are tuned such that a pressure difference between the first side and the second side of the compliant membrane is reduced relative to a microphone having a sealed first or second chamber.

6. The microphone of claim 1 wherein the primary port and the secondary port are tuned such that from about 45 dB to about 70 dB attenuation is observed within a frequency of less than 100 Hz in a microphone signal outputted by the MEMS microphone.

7. The microphone of claim 1 wherein the primary port and the secondary port are tuned such that at least 50 dB attenuation is observed in a microphone signal outputted by the MEMS microphone.

8. The microphone of claim 1 wherein the primary port is formed through a wall of the MEMS microphone housing and the secondary port is formed through the compliant membrane.

9. The microphone of claim 1 wherein one of the primary port or the secondary port comprises a plurality of discrete holes, and the plurality of discrete holes are tuned to have an overall surface area that is different than the surface area of the other of the primary port or the secondary port.

10. A system for indirectly measuring an audio characteristic of a loudspeaker, the system comprising:

a loudspeaker having a diaphragm and a back volume chamber formed around a back side of the diaphragm; and a differential pressure gradient microphone positioned within the back volume chamber of the loudspeaker to indirectly measure an audio characteristic of the loudspeaker, the microphone having a compliant membrane dividing a microphone housing into a first chamber and a second chamber, and wherein the first chamber comprises a primary port open to a first side of the compliant membrane and the second chamber comprises a secondary port open to a second side of the compliant membrane, and wherein the primary port comprises a greater surface area than the secondary port, and their respective surface areas are tuned with respect to one another to control a sensitivity of the microphone to an acoustic output of the loudspeaker, and wherein the surface areas are tuned to achieve at least 10 dB attenuation in a microphone signal outputted by the MEMS microphone.

11. The microphone of claim 10 wherein an acoustic impedance of the primary port and the secondary port are tuned with respect to one another such that the sensitivity of the microphone is controlled so that it is operable to measure the audio characteristic of the loudspeaker at an operating level greater than 130 dB sound pressure (SPL).

12. The microphone of claim 10 wherein a size of the primary port and a size of the secondary port are different, and the size of the secondary port is selected to cause a reduced pressure difference between the first side and the second side of the compliant membrane such that an excursion of the compliant membrane is reduced with respect to a single ported microphone.

13. The system of claim 10 wherein one of the primary port or the secondary port comprises an open surface area sufficient to achieve an at least 10 dB to 30 dB attenuation of a microphone signal output at a first frequency and an at least 45 dB to 70 dB attenuation of a microphone signal output at a second frequency, wherein the first frequency is higher than the second frequency and the attenuation is with respect to a single ported microphone.

14. The system of claim 10 wherein one of the surface areas achieves an at least 10 dB attenuation of the microphone signal output within a frequency of 1 kHz or less with respect to a single ported microphone.

15. The system of claim 10 wherein the primary port comprises a single opening and the secondary port comprises a plurality of discrete openings, wherein an overall surface area of the plurality of discrete openings is different than the single opening.

16. The system of claim 10 wherein the primary port and the secondary port are tuned with respect to one another to control the sensitivity of the microphone in the absence of an acoustic material.

17. The system of claim 10 wherein the audio characteristic of the loudspeaker is one of a displacement, velocity or acceleration of the loudspeaker diaphragm.

18. The system of claim 10 wherein the back volume chamber of the loudspeaker forms a uniform pressure field around the microphone.

19. The system of claim 18 wherein tuning of the primary port and the secondary port with respect to one another causes a difference in magnitude between a sound pressure impinging upon the first side and a sound pressure impinging upon the second side of the compliant membrane.

20. A differential pressure gradient microphone for measuring an acoustic characteristic of a loudspeaker, the microphone comprising:

a microphone housing; and a compliant membrane mounted in the microphone housing, the compliant membrane dividing the microphone housing into a first chamber and a second chamber, and wherein the first chamber comprises a primary port through the microphone housing that is open to a first side of the compliant membrane and the second chamber comprises a secondary port through the microphone housing that is open to a second side of the compliant membrane, the primary port comprises a single opening and the secondary port comprises a plurality of discrete openings, and a surface area of the single opening is greater than an overall surface area of the plurality of openings.

* * * * *